US006143100A

United States Patent [19]

Sun

[11] Patent Number: 6,143,100

[45] Date of Patent: Nov. 7, 2000

[54] BAKE-HARDENABLE COLD ROLLED STEEL SHEET AND METHOD OF PRODUCING SAME

[75] Inventor: Weiping Sun, Trenton, Mich.

[73] Assignee: National Steel Corporation, Mishawaka, Ind.

[21] Appl. No.: 09/162,069

[22] Filed: Sep. 29, 1998

[51] Int. Cl.[7] ..... C21D 8/02

[52] U.S. Cl. ..... 148/533; 148/603; 148/624; 148/652

[58] Field of Search ..... 148/533, 603, 148/624, 652, 654

[56] References Cited

U.S. PATENT DOCUMENTS

| | | | |
|---|---|---|---|
| 3,297,499 | 1/1967 | Mayhem | 148/533 |
| 3,904,446 | 9/1975 | Uchida et al. . | |
| 4,050,959 | 9/1977 | Nakaoka et al. . | |
| 4,313,770 | 2/1982 | Takahashi et al. . | |
| 4,339,284 | 7/1982 | Hashimoto et al. . | |
| 4,410,372 | 10/1983 | Takahashi et al. . | |
| 4,437,902 | 3/1984 | Pickens et al. . | |
| 4,496,400 | 1/1985 | Irie et al. . | |
| 4,589,931 | 5/1986 | Yasuda et al. . | |
| 4,750,952 | 6/1988 | Sato et al. . | |
| 5,123,969 | 6/1992 | Chou . | |
| 5,356,494 | 10/1994 | Okada et al. . | |
| 5,470,403 | 11/1995 | Yoshinaga et al. . | |
| 5,486,241 | 1/1996 | Ushioda et al. . | |
| 5,656,102 | 8/1997 | Taylor et al. . | |
| 5,795,410 | 8/1998 | Liu . | |
| 5,855,696 | 1/1999 | Tezuka et al. | 148/652 |

FOREIGN PATENT DOCUMENTS

| | | |
|---|---|---|
| 0 608 430 A1 | 8/1994 | European Pat. Off. . |
| 0 620 288 A1 | 10/1994 | European Pat. Off. . |
| 2 101 156 | 1/1983 | United Kingdom . |
| 2 234 985 | 2/1991 | United Kingdom . |

OTHER PUBLICATIONS

1994 Proceedings of the Symposium on: "High–Strength Sheet Steels for the Automotive Industry" Oct. 16–19, 1994, pp. 89–102.

"The Effects of Mill Processing Conditions on the Mechanical Behavior of Bake–Hardenable Steel", Cheng–Sheng Lee & Blake K. Zuidema pp. 103–110.

"Development of Bake–Hardenable Steels for Automotive Appliations at Sollac", J.M. Rubianes and P. Zimmer, pp. 111–117.

"Processing and Prestrain Path Effects on the Strain–Aging Behavior of a Batch–Annealed Bake–Hardenable Sheet Steel", Bailey et al. pp. 119 133.

"Development and applications of continuous–annealed low–carbon Al–killed BH steel sheets", Hayashida et al, pp. 135–139.

"Development of Bake–Hardenable and Deep–Drawable Cold–Rolled Sheet Steel", Yie–Shing Hwang et al., pp. 187–193.

"Development of Deep–Drawable and Bake–Hardenable High–Strength Ultra Low–C Steel Sheets by (a+7) and 7 Phase Annealing", Yoshinaga et al., pp. 149–158.

"39th Mechanical Working and Steel Processing Conference Proceedings" vol. XXXV, Oct. 19–22, 1997, pp. 49–61.

"Hot Dip Galvanized Bake–Hardening Grades, a Comparison Between LC and ULC Concepts" A. Pichler et al., pp. 63–81, vol. XXXV, 1998 39th MWSP Conf. Proc., ISS.

"Bake Hardening Steels: Toward ImprovedFormability and Strength" R.P. Foley et al., 39th NWSP Conf. Proc., ISS, vol. XXXV, 1998, pp. 653–666.

*Primary Examiner*—George Wyszomierski
*Attorney, Agent, or Firm*—James L. Bean

[57] ABSTRACT

A bake hardenable cold-rolled steel sheet and a method for producing the steel sheet are provided, wherein the steel sheet includes carbon in a range of about 0.003–0.1 wt. %, with the amount of carbon in solution being about 3–30 ppm, and the steel is substantially free of Ti, Nb, and V, which are otherwise commonly employed in producing low-carbon bake hardenable cold-rolled steel. The method includes a two stage batch or box anneal, a first stage of which is an intercritical batch anneal at a temperature between the $A_1$ and $A_3$ temperatures, and a second, subcritical batch anneal at a temperature below the $A_1$ temperature and above 900° F., with a slow controlled cooling from the intercritical temperature to the subcritical temperature, and from the subcritical temperature to ambient temperature.

12 Claims, 2 Drawing Sheets

BAKE-HARDENABLE COLD ROLLED STEEL SHEET AND METHOD OF PRODUCING SAME

BACKGROUND OF THE INVENTION

1. Field of the Invention

The present invention is directed to cold rolled steel sheet products and a method for making the same. In particular, the cold rolled steel sheet has excellent formability, bake hardenability, and dent resistance, and is resistant to aging.

2. Description of Related Art

Currently, high strength steel sheets, especially IF (interstitial free) rephosphorized Al-killed steel sheets with high yield and tensile strength, are being used by automobile manufactures to reduce vehicle weight and improve the mileage economy. Due to their relatively high yield strength, the steel sheets do not conform closely to stamping dies during stamping or forming, and thus sometimes cause undesirable surface deflection in the formed parts. Therefore, steel sheets with low yield strength before stamping and high yield strength in the final finished products are desired.

For this reason, steel sheets having bake hardenability and superior press shapability have been developed in the recent years. As used herein, the term bake hardenability refers to the hardening or strengthening that occurs during a paint baking or coating treatment, in which the steel sheet is typically held for about 20 to 40 minutes at a temperature ranging from 250 to 450° F. (121 to 232° C.). Due to such bake hardening or strengthening, this type of steel sheet can provide desired excellent dent resistance in the final product. A key characteristic of bake hardenable steel sheet to be used in producing automobile panels is that it should have high ductility and thus excellent formability prior to the bake hardening being conducted. This prolongs the life of forming tools and enables various different types of shapes to be easily produced, in that the press forming or shaping is conducted prior to the bake hardening step.

The previous research and development in this field has resulted in several methods for producing cold-rolled bake-hardenable steel sheets using a continuous, or in-line, annealing approach, several examples of which are discussed below.

U.S. Pat. No. 5,656,102 and U.S. Pat. No. 5,556,485 to Taylor et al. disclose effective amounts of vanadium in low carbon steels to produce an improved bake hardenable product for automotive use. The use of vanadium in the alloy steel chemistry controls bake hardenability, permits solution annealing at lower temperatures in its manufacturing sequence, and enables the use of a composition range which is more easily cast within desired limits and causes less variation in final mechanical properties. The effective annealing temperature range for this steel can be as low as around 1450° F. (788° C.) and up to about 1650° F. (899° C.). The solution annealing temperature is preferably within the range of 1500 to 1550° F. (816 to 843° C.), according to these patents.

U.S. Pat. No. 5,486,241 to Ushioda et al. discloses a non-aging extremely low carbon (0.0001 to 0.0015% C) ferritic single-phase cold-rolled steel sheet or hot dip galvanized steel sheet for deep drawing, and which has fabrication embrittlement resistance and paint bake hardenability. A continuous annealing process is conducted after the cold rolling of the steel sheet.

U.S. Pat. No. 5,470,403, European Patent 0,620,288 A1, and European Patent 0,608,430 A1 to Yoshinaga et al. disclose an extremely low carbon cold-rolled steel sheet and a hot dip zinc-coated cold-rolled steel sheet with bake hardenability characteristics. For this product, at least one element selected from the group consisting of Ti and Nb is used in the alloy chemistry. A continuous annealing procedure is also employed, with an annealing temperature from at least the a→y transformation point to up to the $A_{c3}$ transformation point.

U.S. Pat. No. 5,356,494 to Okada et al. discloses a high strength cold-rolled steel sheet having non-aging properties, drawability, and bake hardenability characteristics. This steel sheet has a dual-phase structure, and is produced by preparing a hot-rolled steel sheet, cold rolling the hot-rolled steel sheet at a rolling reduction not smaller than 60%, continuously annealing the cold-rolled steel sheet at a temperature which is not lower than the a→y transformation start temperature, but which is also below the $A_{c3}$ transformation temperature, and cooling the continuously annealed steel sheet at a rate not less than 9° F./sec (5° C./sec), but not greater than 180° F./sec (100° C./sec).

U.S. Pat. No. 5,123,969 to Chou discloses a cold-rolled steel sheet which has good bake hardenability, good dent resistance, and a low yield ratio. After melting, continuous casting, hot rolling, coiling and cold rolling, the steel sheet is soaked at a temperature ranging from 1436° F. (780° C.) to 1652° F. (900° C.) for less than five minutes preceding an intercritical (a+y) continuous annealing treatment.

U.S. Pat. No. 4,750,952 to Sato et al. discloses a cold-rolled steel sheet for deep drawing having improved bake hardenability. Titanium is added to this steel, and restricted to a specific range in consideration of the sulfur and nitrogen amounts. Such a cold-rolled steel sheet is obtained by continuously annealing the steel sheet after the cold rolling, provided that a residence time over a temperature region above recrystallization temperature is within 300 seconds.

U.S. Pat. No. 4,859,931 to Yasuda et al. provides a method for producing a thin bake hardenable cold-rolled steel sheet. This patent discloses an effective compounding amount of Ti which acts to fix the C, S and N contained in the steel, and a continuous annealing condition properly selected based upon the effective amount of Ti.

U.S. Pat. No. 4,496,400 to Irie et al. relates to a thin cold-rolled steel sheet suitable for external automotive plate. This patent discloses an effective compounding amount of Nb, which acts to fix C and N in the steel in the presence of a proper amount of Al, and a continuous annealing condition which produces the desired results with the addition of Nb.

U.S. Pat. No. 4,410,372. to Takahashi et al. discloses a process for producing deep-drawing, non-aging, cold rolled steel strip having paint bake hardenability, by continuous annealing the steel strip. In this patent, the cold-rolled steels are limited to Al-killed steels containing 0.001–0.01% C, not more than 1.5% Mn, 0.005–0.20% Al, not more than 0.007% N, and B in amounts determined by the ratio of B/N ranging from 0.5 to 2.5, and optionally containing not less than 1% Si and 0.04 to 0.12% P.

U.S. Pat. No. 4,050,959 to Nakaoka et al. provides a process of making a high strength cold reduced steel sheet having bake hardenability and non-aging properties. In this patent, the chemical composition is substantially controlled such that Mn is in the range of 10×[S]% up to 2.99%, N is in the range 0.003 to 0.02% and Al is less than $5\times10^{-4}$/[N]%. The cold reduced steel is subjected to a full continuous annealing process comprising a heating step to heat the strip to a temperature between $A_{c1}$ and 1652° F. (900° C.) within 5 to 180 sec., a rapid cooling step from the heated temperature to substantially room temperature by water-spray, a reheating step to heat the strip from room temperature to a temperature in the range of 302° F. (150° C.) to 842° F. (450° C.) within 5 to 300 sec., and then a final cooling step.

U.S. Pat. No. 3,904,446 to Uchida et al. discloses a process of making high strength cold-rolled steel having bake-hardening characteristics. In this patent, the chemical composition is substantially controlled such that carbon is in the range of 0.04 to 0.12% C and manganese is in the range of 0.1 to 1.60%. After being cold reduced, the steel strip is continuously heated to a temperature in the range of 1292 to 1652° F. (700 to 900° C.), is then rapidly cooled by a jet of water, and is then reheated to a temperature in the range of 356 to 752° F. (180 to 400° C.) and held for 2 to 300 seconds at that temperature to leave a portion of the carbon in solution in the steel.

U.K. Patent GB 2,234,985 to Okamoto et al. relates to a bake hardenable steel of a composition, by weight, of 0.0010–0.0030%C, 0.04–0.30% Mn, 0.04–0.20% P, 0.003–0.015% Si, at most 0.15% soluble Al, at most 0.0020% N, and 0.003–0.025% Ti, and requires a specific relationship between N, Ti and S. The steel may also contain Nb and/or V, and optionally B, the balance being Fe and unavoidable impurities.

UK Patent GB 2,101,156 to Shibata et al. discloses a process for producing deep-drawing, non-aging cold-rolled steel strip having bake hardening properties. The process subjects the starting material to ordinary hot and cold rolling operations, and then the strip is soaked at a temperature in the range of from 1346° F. (730° C.) to the $A_3$ point by a continuous annealing process. The strip is rapidly cooled from a temperature between the soaking temperature and 842° F. (450° C.) down to a temperature not higher than 482° F. (250° C.) with an average cooling rate of not less than 108° F./sec (60° C./sec).

All of the above patents or publications are related to the manufacture of cold-rolled bake hardenable steel sheets using a continuous annealing method. Compared to batch annealing, continuous annealing can provide steel sheets which exhibit more uniform mechanical properties, better flatness and cleaner surface. However, the drawability and anti-aging properties of these steel sheets are inferior to those produced by batch annealing, due to the rapid heating and cooling cycles encountered in continuous annealing. Not enough solute carbon and nitrogen can be fixed as carbides, nitrides or carbonitrides by making the solute carbon and nitrogen precipitated during cooling step of continuous annealing. As a result, a large amount of solute carbon and nitrogen remains in the annealed steel sheet. Therefore, when the annealed steel sheet is left to stand for a long period of time before the steel sheet is pressed, the steel sheet ages at room temperature.

As also indicated in these patents or publications, very tight chemistries and processing controls are necessary for the production of bake hardenable steel sheets using a continuous annealing approach. In order to improve formability when continuous annealing is to be employed, ultra low carbon and nitrogen concentrations are needed, which, in turn, requires advanced steelmaking equipment and increases the production cost. Furthermore, for the purpose of controlling the stability of carbon and nitrogen, and thus the bake hardenability and anti-aging properties of the steel sheet, certain amounts of expensive alloys, such as titanium, niobium and vanadium, are usually added to the steel. This further increases the manufacturing cost.

U.S. Pat. No. 4,339,284 to Hashimoto et al. relates to a process which employs batch annealing technology. This patent discloses a method of producing non-aging cold rolled steel sheets capable of being deep drawn, wherein an extra low-carbon steel is melted together with niobium. The molten steel is made into an ingot, the ingot is slabbed, and then the slab is subjected to a hot rolling, a cold rolling and a batch annealing according to a common method. The patent is not concerned with bake hardenability of the steel sheet.

U.S. Pat. No. 4,313,770 to Takahashi et al. also involves batch annealing. The method disclosed in this patent comprises hot rolling, pickling, cold rolling, then passing the resulting steel strip to a batch annealing furnace in which the steel strip is subjected to recrystallization annealing by heating it at a temperature lower than 1400° F. (760° C.), but higher than the recrystallization temperature of the steel, and cooling it in the temperature range from 932 to 392° F. (500 to 200° C.) at an average cooling rate of 18 to 450° F./hour (10 to 250° C./hour), and then temper rolling the annealed steel strip.

As noted in this patent, the total elongation of the steel sheets produced using the above annealing cycle is often below 35%. This has been borne out in testing conducted in conjunction with the development of the present invention, wherein similar and even lower elongation values were obtained. The steel sheets obtained by the method in that patent also can exhibit aging at room temperature.

Despite the concerted activities in obtaining deep drawing, bake hardenable steel sheet, as evidenced in part by the relatively large number of patents noted above, a need still exists to develop new methods which improve the formability and non-aging property of cold-rolled steel sheet, in order to meet current shaping requirements for automobile, electrical appliance and building components.

The present invention has as a principal object thereof the provision of a batch annealing method, which has less demanding chemistry and processing requirements, for producing cold-rolled steel sheet and zinc or zinc-alloy coated cold-rolled steel sheet having improved formability, and excellent bake hardenability, dent resistance and non-aging properties.

A further object of the present invention is to provide a practical manufacturing method for making cold-rolled steel sheet and zinc or zinc-alloy coated cold-rolled steel sheet having improved formability and excellent aging resistance prior to forming. This method has less demanding processing requirements and can be carried out using less expensive steelmaking equipment.

Another object of the present invention is to provide a cold-rolled carbon steel sheet and coated cold-rolled carbon steel sheet having excellent bake hardenability, dent resistance, press shapability and non-aging property. This type of steel sheet is less expensive due to the less demanding chemistry requirements, neither requiring extra low carbon level nor containing expensive alloy elements, such as Ti, Nb and V.

Other objects and advantages of the present invention will become apparent from the description that follows.

SUMMARY OF THE INVENTION

The above and other objects of the present invention are achieved by a method for producing bake-hardenable, cold-rolled steel sheet, including a batch annealing step, as follows:

(a) producing or obtaining a steel slab, preferably of a composition including (in weight percentages) about 0.005–0.1% carbon, not more than about 1.5% manganese, not more than about 1.0% silicon, not more than about 0.1% phosphorous, not more than about 0.03% sulfur, about 0.0001–0.01% nitrogen, acid-soluble aluminum in an amount at least about 1.9 times the amount of nitrogen, but not more than 0.2% of the alloy composition, and the remainder iron and unavoidable impurities;

(b) hot rolling the steel slab to form a hot-rolled band;

(c) coiling the hot-rolled band at a temperature not higher than about 1450° F. (788° C.);

(d) cold rolling the hot-rolled and coiled band to a desired thickness, with the total draft or reduction being not less than 50%;

(e) batch annealing the cold-rolled steel sheet in a batch furnace at a temperature higher than the $A_1$ temperature and lower than the $A_3$ temperature, with at least about a 30 minute holding time;

(f) cooling the steel sheet at a rate slower than about 270° F./hour (150° C./hour) to a temperature between the $A_1$ temperature and 900° F. (482° C.);

(g) holding the steel sheet in the temperature range of step (f) for at least about 30 minutes to obtain an optimum amount of carbon in solution and to achieve a desired carbide distribution;

(h) cooling the annealed steel sheet at a rate slower than about 270° F./hour (150° C./hour) to a temperature lower than about 752° F. (400° C.).

In the foregoing process, the steel slab can be formed either by continuous casting or by ingot casting. Further, in the final processing of the steel sheet, a zinc or alloyed zinc coating may be applied to the surface, if desired, and the sheet may be press formed or otherwise formed into desired end shapes for any final application.

DETAILED DESCRIPTION OF THE PREFERRED EMBODIMENTS

Figure 1:
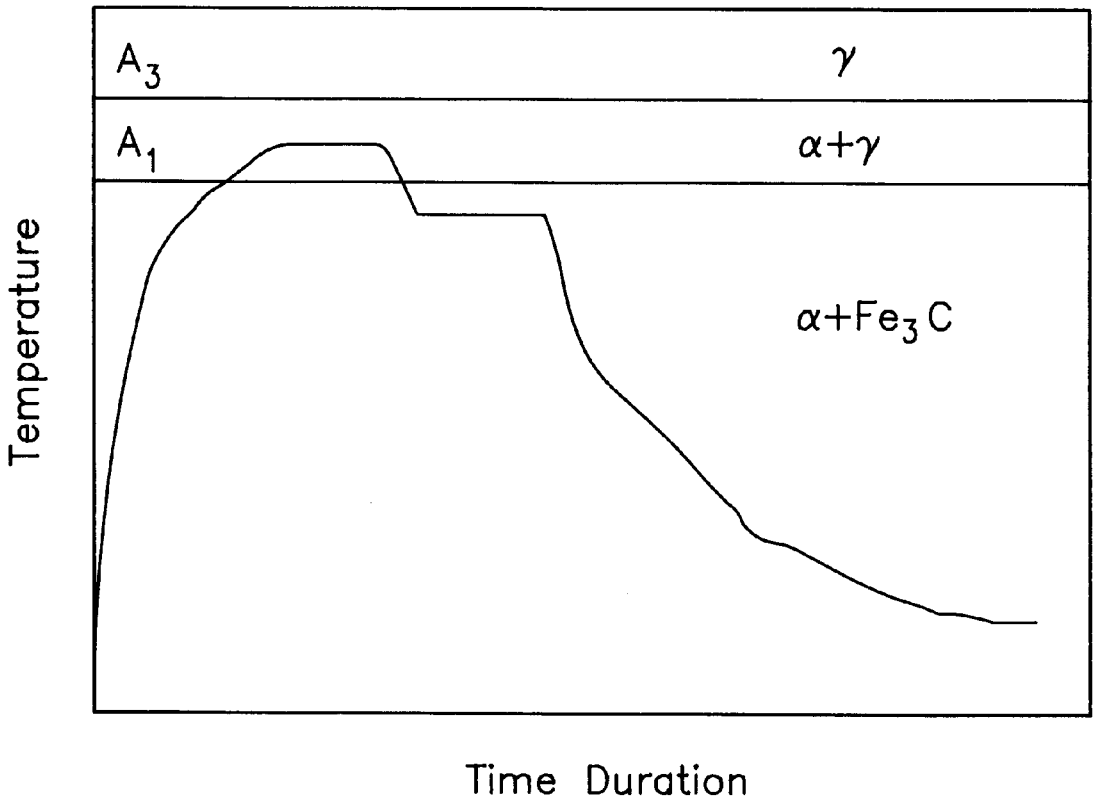
FIG. 1 is a graph providing a schematic representation of the thermal cycle involved in the batch annealing portion of the method of the present invention.

The present invention is directed to cold-rolled and annealed steel sheet and methods of making such a steel sheet. In a preferred embodiment, the steel sheet is batch annealed and optionally coated by techniques such as hot-dip coating or electrogalvanizing for use in automobile sheet or plate. The process of the preferred embodiment also is directed to manufacturing inexpensive cold-rolled steel sheet having excellent bake hardenability, dent resistance, formability, and/or resistance to aging.

In the development of the method and steels of the present invention, the main metallurgical factors which control bake hardenability, formability and non-aging property were explored and studied extensively. The following findings and conclusions were reached as a result of the studies:

(1) It is possible to control both the bake hardenability and room-temperature aging properties of the steel by controlling the amount of carbon that is in solution in the steel. This will affect the strain aging characteristics of the steel which occurs due to pinning of mobile dislocations by solute carbon and nitrogen atoms. Carbon in solution is desirably in the range of about 3 to 30 ppm to obtain excellent bake hardenability while maintaining non-aging properties in the steel.

(2) For the same level of bake hardenability, steels having a higher solute nitrogen level display a much higher susceptibility to room temperature aging. It was thus determined that nitrogen in solution is a principal cause of room temperature aging. Thus, in order to reduce the yield point elongation (YPE) and avoid breaks, cracking or other mechanical failure during stamping, the solute nitrogen level in the steel sheet must be kept as low as possible and practicable.

(3) Increasing the carbon in solution reduces the formability of cold-rolled steel sheet and coated cold-rolled steel sheet. In addition, large amounts of carbon in solution also cause room-temperature aging, as noted above, which further causes the yield stress to increase and the elongation to decrease.

(4) Higher dislocation densities in the annealed steel sheet prior to press forming lead to lower formability because carbon atoms segregate along the dislocation lines, which increases the yield strength.

(5) Smaller subgrains formed in the matrix lead to decreased formability. This is because smaller subgrains are not as effective in producing scalloping of the grain boundaries, and grain boundary sliding is thus not impeded as effectively during stamping.

(6) When the average sizes of ferrite grains and subgrains are same, better formability of the steel is obtained when the steel sheet has a more uniform structure.

In developing the present invention, the following effects of various processing conditions on the above metallurgical factors were determined:

(1) Elimination or relaxation of the chemistry restrictions that attend the continuous annealing processes, discussed previously, can desirably be achieved using a relatively higher carbon concentration and a process involving batch annealing. The avoidance of the tight chemistry restrictions reduces the steelmaking cost.

(2) It is intended that, in Al-killed carbon steels, nitrogen will precipitate as aluminum nitrides. Although aluminum nitride precipitates can be formed during the coiling of hot-rolled steel bands, these particles are not stable during later annealing of the steel sheets which is conducted after cold-rolling.

(3) Stable aluminum-nitrides and iron-nitrides, which effectively minimize the nitrogen content in solution, can be obtained preferably by employing a slow cooling rate after annealing. Such a low cooling rate can be obtained through the use of batch annealing, but cannot practically be obtained using continuous annealing.

(4) In a conventional batch annealing process, the cold-rolled steel sheet is annealed at a subcritical temperature in the ferrite region. In this case, cementite particles are present during the soaking period. These particles, in conjunction with ferrite grain boundaries, act as the major precipitation sites for carbon during a subsequent cooling stage. Therefore, the amount of carbon in solution will be significantly decreased. If a suitable subcritical annealing temperature and cooling rate are used, it is possible to obtain a solute carbon level of 3 to 30 ppm, which is the desired range for the steels of the present invention. However, in this temperature range, the recovery process in the cold worked matrix can gradually lead to considerable softening, because the stacking fault energy is relatively high in ferrite. Since the recovery process competes with the recrystallization process, the driving force for recrystallization and subsequent growth of new grains is reduced. As a result, a relatively higher dislocation density remains in the steel, and smaller subgrains are formed in the final ferrite matrix, which contributes to a decrease in formability of the steel sheet, as described above.

(5) During an intercritical batch annealing process, the cold-rolled steel sheet is heated to and soaked in the dual phase (ferrite and austenite) region. The recrystallization process can easily proceed during such annealing. Lower dislocation density and larger subgrains can thus be obtained if cooling rate is properly controlled. However, the cementite particles exist only on the ferrite grain boundaries under these processing conditions. The density of precipitation sites for carbon is therefore significantly reduced. Thus, the annealed steel sheet can retain larger amounts of carbon in solution than is desired in the steels of the present invention, as higher amounts of carbon in solution can, as noted previously, impair the anti-aging properties and formability of the steel.

Taking into account the foregoing processing phenomena, the method or process of the present invention was developed. The method involves, first, batch annealing a cold-rolled steel in the intercritical region, between the $A_1$ and $A_3$ temperature of the steel, and then annealing the steel in the subcritical region, i.e., below the $A_1$ temperature. Using such processing conditions, the best combination of desired microstructure and the optimum amount of carbon in solution can be obtained. The initial intercritical batch anneal, followed by a subcritical batch anneal, is also referred to herein as a staged batch annealing process or technique. FIG. 1 illustrates graphically the staged batch annealing process showing the temperature history as a function of time during the staged batch anneal.

In the first, intercritical, stage, represented by the portion of the plot between the $A_1$ and $A_3$ temperatures, a recrystallization and partial transformation anneal of the cold-rolled steel sheet is effected, to improve formability by reducing the number or density of dislocations which are generated during the prior cold rolling. In a second, subcritical, stage, the steel sheet is cooled to a temperature below the $A_1$ temperature, which is known as and referred to as the subcritical region. To further improve formability, a uniform ferrite microstructure with relatively large subgrains is produced during cooling by controlling the cooling rate appropriately between the first and second stages. To control bake hardenability, the optimum solute carbon level and carbide distribution are obtained during the second stage of annealing in the subcritical region. To assure that the steel has the desired resistance to aging, solute nitrogen is finally precipitated to form stable aluminum-nitrides during the subsequent cooling after the second stage subcritical anneal. Carbide morphology is also modified during this cooling. The staged annealing process may also advantageously be used to produce steels having high formability, but not necessarily having other properties such as bake hardenability.

A more specific recitation of a preferred process includes the following steps:

(1) preparing a melting steel which contains, by weight, not less than 0.005% but not more than 0.1% of carbon, not more than 1.5% of manganese, not more than 1.0% of silicon, not more than 0.1% of carbon, not more than 1.5% of manganese, not more than 1.0% of silicon, not more than 0.1% of phosphorus, not more than 0.03% of sulfur, not less than 0.0001% but not more than 0.01% of nitrogen, acid-soluble aluminum in an amount of at least 1.9 times amount of nitrogen and at most 0.2%, and the remainder being iron and unavoidable impurities;

(2) preparing steel slab by continuous casting or ingot casting the melting steel;

(3) hot rolling the steel slab into a hot-rolled band;

(4) coiling the hot-rolled band at a temperature not higher than 1450° F. (788° C.);

(5) cold rolling the hot-rolled band into a cold-rolled steel sheet of a desired thickness using a total draft or reduction of not less than 50%;

(6) in a first annealing stage, heating the cold-rolled steel sheet in a batch furnace to a temperature higher than the $A_1$ temperature but lower than the $A_3$ temperature, that is, in the intercritical region, and holding the steel sheets in this region for at least 30 minutes to allow the recrystallization and partial transformation annealing to proceed, which effectively causes a reduction of the density of dislocations which are generated during prior cold rolling, and which produces larger subgrains;

(7) in a second annealing stage, cooling the steel sheet at a rate of slower than about 270° F./hour (150° C./hour) to a temperature lower than the $A_1$ temperature but higher than 900° F. (482° C.), that is, into the subcritical region, to form a uniform ferrite microstructure with relatively large subgrains, and holding the steel sheet at the subcritical region temperature for at least 30 minutes, to obtain an optimum amount of carbon in solution and a desired carbide distribution, in controlling bake hardenability;

(8) cooling the annealed steel sheet at a rate of slower than about 270° F./hour (150° C./hour) to a temperature lower than about 752° F. (400° C.), to form stable aluminum-nitrides and to further modify carbide morphology to assure that the steel will exhibit to resistance to aging; and (9) if desired, coating the steel sheet with a coating such as a zinc coating or an alloyed zinc coating, and, further, forming the sheet into a desired shape for a final application.

The method according to this invention imposes less demanding chemistry requirements on the composition of the steel to be produced. Neither an extra low carbon level, nor the addition of expensive alloying elements, such as Ti, Nb and V, are required. As used herein, when the preferred steel is referred to as being "substantially free" of Ti, Nb and/or V, this is intended to mean that these elements are not deliberately added to the melting steel to be cast into slabs, although trace amounts of these elements may, in fact, be present in the steel. The preferred ranges of the other elements desirably contained in the steel can also be readily obtained in the manufacturing process. The desired limitations on the steel composition and the reasons for these desired limitations according to the present invention will be discussed in more detail below.

The carbon content, and, more particularly, the amount of carbon in solution in the cold-rolled and annealed steel sheet, affects the bake hardenability of the steel. Thus, if the amount of carbon in solution is too s mall, the degree to which the steel will strengthen or harden in a bake hardening process, in the absence of expensive alloying elements, will be low. The cost of producing bake hardenable steels having extra-low carbon contents is high, due to the necessity of adding the expensive alloying elements, and of having to use advanced processing equipment. Thus, the lower limit of carbon content is limited to about 0.003% by weight in the preferred embodiment of the present invention.

When the carbon content is in between about 0.003% and 0.005% by weight, however, a single phase ferrite region is formed at high temperatures. Nearly no cementite particles exist during batch annealing of such a material to act as the nucleation sites for carbides, and only some grain boundaries will serve as potential sites for carbon to precipitate. As a result, most of the carbon atoms are kept in solution even when slow cooling is employed, which can cause room-temperature aging leading to a reduction in the formability of the steels. A more preferable lower limit of the carbon content is therefore given as 0.005% by weight. At and above this carbon content, desirable am ounts of the carbon atoms can and will be precipitated during the batch annealing and subsequent cooling to give the steel better resistance to room-temperature aging.

Since large amount of carbides and/or carbon in solution could impair the processability of the resulting steel sheet, the preferred upper limit of the carbon content is on the order of about 0.1%. To obtain excellent bake hardenability while assuring resistance to aging, the amount of carbon in solution in the final steel products is in the range of about 3–30 ppm and preferably in the range of about 5–20 ppm.

In general, manganese acts as a basic element in enhancing the strength of steel sheet. The actual amount of this element in the steel varies according to the desired strength level of the steel. In the present invention, wherein titanium and other elements which have conventionally been added to enhance bake hardenability are not employed, manganese also fixes sulfur to form manganese sulfides to prevent edge cracking during hot rolling. On the other hand, recrystallization progress during batch annealing is retarded by the manganese sulfide particles and/or the clustering of manganese and sulfur atoms in the cold-rolled steel sheets. Furthermore, when the steel is subjected to hot dip galvanizing or hot dip galvannealing, large amounts of manganese oxides are formed on the substrate surface if the manganese content is high. These manganese oxides are not uniformly distributed across the surface and cannot be completely reduced to manganese in the coating pot. Since these manganese oxides have poor wettability with zinc, failures of the surface coating by the zinc or zinc alloy could occur. It is therefore preferred that the amount of manganese be limited to less than about 1.5% by weight.

Similar to manganese, silicon is an element useful for increasing the strength of the steel, but harmful to the integrity of a zinc coating or alloyed zinc coating due to the formation of silicon oxides which decrease the adhesion of hot-dip zinc coatings to the surface of the steel sheet. Also, silicon has a pronounced effect in decreasing the growth rate of carbides. This is because silicon is rejected from the carbides and increases the activity of carbon in ferrite. As a result, the gradient in carbon activity in the surrounding matrix is increased, which decreases the diffusion rate of solute carbon atoms toward the growing carbides. This results in an increase in the amount of the carbon in solution. Moreover, silicon raises the cementite initiation temperature and the ferrite-to-austenite temperature, and thus the annealing temperature for the cold-rolled steel sheet would necessarily be increased considerably to achieve the required properties in the process of the present invention. Accordingly, the upper limit of silicon content is defined to preferably be about 1.0% by weight.

The addition of phosphorus leads to grain refinement, particularly where titanium, niobium and vanadium are all essentially absent, as in the preferred embodiment herein. Thus, phosphorus, a low cost additive, aids in improving the strength of the steel through strengthening as a result of grain refinement, and by its solution strengthening. However, the segregation of phosphorus at grain boundaries which may occur as a result of certain heat treatments of the steel, including any tempering thereof, has been linked to brittleness in steel. When a large amount of phosphorus is added to the steel, the weldability and rollability of the steel sheet also deteriorate. If the content of phosphorus is higher than about 0.1% by weight, the alloying reaction during hot dip zinc coating is markedly retarded, and thus the production rates in producing hot-dip coated steel are significantly increased. Furthermore, steels having high phosphorus contents exhibit increased yield strengths, and thus the formability of the steel is markedly reduced. For these reasons, the upper limit of phosphorus content is preferably defined to be about 0.1% by weight.

Sulfur is not normally added to the steel because a lower sulfur content is desirable. However, sulfur is generally present as a residual element, the amount of which depends on the initial steelmaking process employed. Since the steel of the present invention preferably contains manganese, sulfur will precipitate in the form of manganese sulfides, as described above. A large amount of manganese sulfide precipitates greatly deteriorates the formability of the steel. The preferred upper limit of sulfur content is accordingly defined to be about 0.03% by weight.

Nitrogen is a harmful element in the steel of the present invention. The lower the nitrogen concentration, the better the anti-aging properties of the steel sheet. However, the production cost becomes extremely high when attempts are made to control the nitrogen content to levels less than 0.0001% by weight. The preferred lower limit of nitrogen content in the present invention is thus defined to be about 0.0001% by weight, from a production cost effectiveness perspective. Where increased cost can be justified, or if more economical measures are developed for reducing the nitrogen content, the preferred lower limit would be as small an amount as practicable. When the nitrogen content exceeds about 0.01% by weight, it becomes essentially impossible to fix all of the nitrogen atoms with aluminum, even when the cooling rate is properly controlled after the annealing treatment. In this situation, excess nitrogen remains in solution and the steel will thus be susceptible to room temperature aging. For this reason, the preferred upper limit of nitrogen content is defined to be about 0.01% by weight.

Aluminum is employed for deoxidation of the steel and for fixing nitrogen to form aluminum nitrides. Theoretically, an acid-soluble amount of (27/14)N, i.e., 1.9 times amount of nitrogen, is required to fix all of the nitrogen as aluminum nitrides. Therefore, the preferred lower limit of aluminum content is defined to be 1.9 times the amount of nitrogen. If the content of acid-soluble aluminum exceeds 0.2%, however, the formability of the steel is markedly decreased. Moreover, a large amount of aluminum in the alloy also significantly raises the cementite initiation temperature for a given annealing time and increases the time required for cementite formation at a given temperature, which would thus increase the cost of the annealing process. The preferred amount of aluminum is thus at most about 0.2%.

Other impurities should be kept to as small a concentration as is practicable.

By employing a steel falling within the above compositional or chemistry constraints, and by employing the staged batch annealing technique, the process will have less demanding or restrictive processing requirements. In addition, the equipment, particularly the annealing furnace and associated equipment for batch or box annealing, can be far less expensive, as compared with, for example, equipment required to conduct continuous annealing. Thus, the capital costs involved in conducting the process will be lower.

Figure 2:
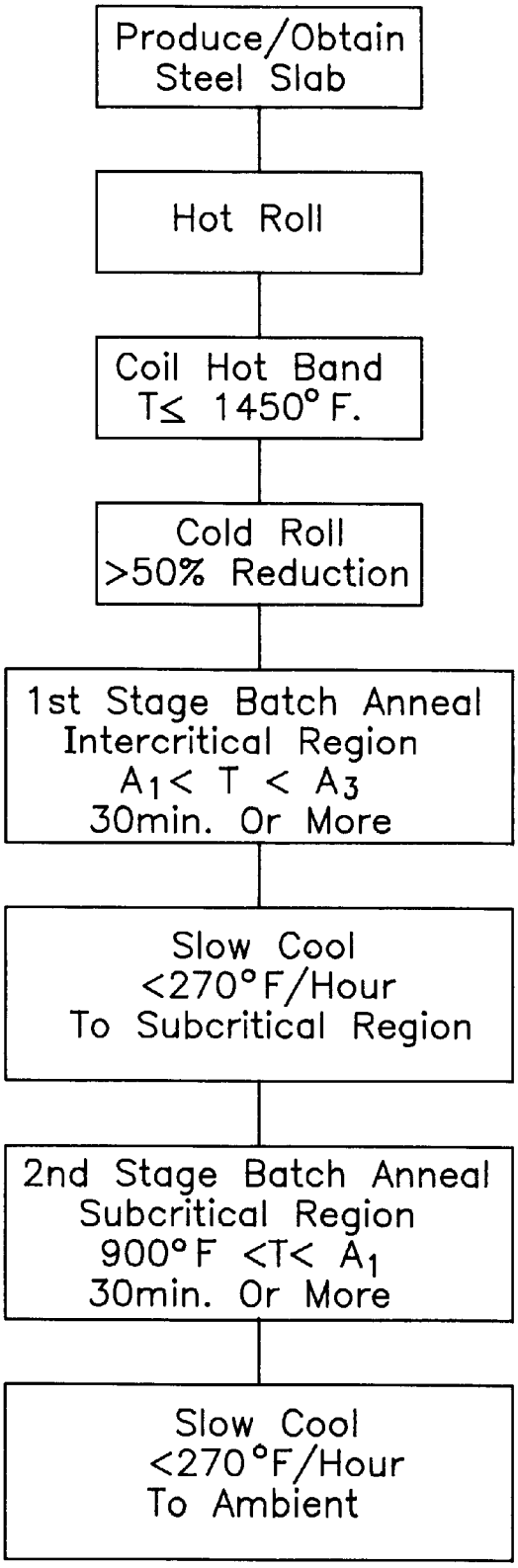
FIG. 2 is a flow diagram which summarizes the process steps of the method of the present invention.

FIG. 2 is a process flow diagram which summarizes the basic steps of the process. In the process, a steel having a composition falling within the ranges discussed above is cast using a conventional continuous slab caster or a conventional ingot caster to produce a slab having a thickness suitable for hot rolling into a hot rolled band, alternatively referred to as a hot band.

The steel composition, subsequent processing and final product properties in accordance with the present invention are not dependent on control of specific processing conditions during hot rolling, and thus conventional hot rolling conditions are suitable for the process. The slab is heated, or soaked, by heaters to a temperature in the range of about 1800–2450° F. (982–1343° C.) and passed through a hot roll stand, where the slab is hot rolled into a hot band, in any practicable temperature range. The hot band is coiled by a conventional coiler when the hot band has cooled to a temperature not higher than about 1450° F. (788° C.). Coiling may be effected at essentially any temperature below 1450° F. (788° C.) down to room temperature. It is preferred, in order to obtain better formability and drawability properties, to start the coiling at a temperature below about 1250° F. (677° C.). Precipitation of aluminum nitrides can be arrested during the coiling process at the lower coiling temperatures. Although such precipitated aluminum nitrides are not very stable and may be dissolved in the latter stages of annealing, their presence in the hot band will have a pinning effect on grain growth during the batch annealing once the hot band has been cold-rolled, and this can have a lasting effect on the formability and drawability of the as-annealed steel sheet products.

At a desired time after the hot band has been coiled and cooled, the hot band is subjected to cold rolling into steel sheet thicknesses. A conventional cold rolling stand can be used to cold roll the hot band to the desired final thickness of the sheet. It is desired to reduce the thickness of the cooled hot band by at least about 50% (total draft or reduction), in order to attain sufficient driving force for recrystallization in the sheet during the subsequent batch annealing. This will, in turn, assure that the finished steel sheet product will have the desired formability and drawability properties.

Following cold rolling, the steel sheet is annealed using the aforenoted staged batch annealing technique or procedure. The cold-rolled steel is transferred to a conventional batch annealing furnace and is heated in the furnace to a temperature in the intercritical region, that is, to a temperature higher than the $A_1$ temperature of the material, but lower than the $A_3$ temperature.

This first stage of batch annealing reduces the density of the dislocations which were generated during cold rolling, and produces larger subgrains. It is therefore important to assure that recrystallization and partial transformation occurs during this stage of annealing. A holding time for this first annealing stage in the intercritical temperature region is thus preferably at least about thirty (30) minutes, and may nominally be on the order of several hours to tens of hours.

Following the first annealing stage, at the end of the predetermined holding time for that stage, the steel sheet is cooled, preferably in the annealing furnace 108, to a subcritical temperature region, namely to a temperature lower than the $A_1$ temperature, to commence a second annealing stage. During this cooling to the subcritical temperature, it is desired to obtain a uniform ferritic microstructure with relatively large subgrains, and therefore it is desired to use a relatively slow cooling rate with an upper limit on the order of 270° F./hour (150° C./hour).

It is preferred, in this second annealing stage, that the steel sheet be maintained at a temperature above about 900° F. (482° C.), resulting in a preferred temperature range for this stage of between about 900° C. (482° C.) and the $A_1$ temperature. An even more preferred lower temperature limit for this second, subcritical anneal, is ($A_1$–270)° F., alternatively stated as ($A_1$–150)° C.

Two main objectives of the second, subcritical, annealing stage are to obtain the desired or optimum amount of carbon in solution, and a denser and more uniform carbide distribution, due to a higher density and more uniform distribution of nucleation sites for carbide precipitation attained during this annealing stage, both of which, as noted previously, contribute to the control of the bake hardenability of the steel sheet. To best achieve these objectives, the holding time for the second stage anneal is preferably at least about thirty (30) minutes. The holding time may normally be on the order of several hours to about ten (10) hours.

After the second stage anneal, the steel sheet is cooled at a rate not exceeding 270° F./hour (150° C./hour), to a temperature lower than about 752° F. (400° C.). Setting an upper limit on the cooling rate after the subcritical anneal is important, in order to allow the formation of stable aluminum nitrides and iron carbides.

The method of the invention may further include conventional coating treatments and/or the sheet may be press formed or otherwise shaped for a variety of end uses. A main end use envisaged for the steel sheet produced in accordance with this process is for automotive body panels and parts. Thus, the steel sheet, once formed, will be painted and baked, which will cause the steel to undergo bake hardening, thereby improving dent resistance, an important property for the exposed automotive panels. In this application, a zinc coating or alloyed zinc coating is desirably applied by hot dipping or electrogalvanizing.

EXAMPLE 1

In the course of developing the present invention, steel slabs having the following composition were prepared:

| Component | Wt. % |
|---|---|
| C | 0.027 |
| Mn | 0.24 |
| Si | 0.010 |
| P | 0.011 |
| S | 0.010 |
| N | 0.0038 |
| Al | 0.033 |
| Fe | balance |

The steel slabs were then subjected to hot rolling, pickling, cold rolling, batch annealing, coating and temper rolling.

Hot bands with final thicknesses of 0.104" were processed using an average finishing exit temperature (hot rolling termination temperature) of 1607° F. (875° C.) and average coiling temperatures ranging from 1068° F. (576° C.) to 1200° F. (649° C.). Employing a total reduction of about 71%, these hot bands were cold reduced to the final thickness of 0.03". Then, the staged batch annealing operation of the present invention was conducted for the cold-rolled samples. The annealing temperature and holding time were 1400° F. (760° C.) and 7 hours in the first stage, and 1270° F. (688° C.) and 10 hours in the second stage, respectively. The furnace atmosphere for the batch annealing stages was 5% $H_2$ and 95% $N_2$. Following batch annealing, a zinc coating treatment was performed using a hot dip galvanizing technology. During that surface treatment, two different line speeds, 150 ft/min and 350 ft/min were used, with the maximum steel temperature being of 1050° F. (566° C.). The galvanized sheets were then temper rolled using, for various samples, 1.0%, 1.5% and 2.0% extension. Finally, standard ASTM mechanical testing was conducted on the specimens obtained under the specified processing conditions.

Table 1 below provides a summary of the mechanical properties obtained for the specimens following batch annealing, and prior to being hot dip coated and temper rolled.

TABLE 1

| | Coiling Temperature (° F.) | Yield Strength (ksi) | Tensile Strength (ksi) | Total Elongation (%) | n-value |
|---|---|---|---|---|---|
| A | 1068 | 28.4 | 42.2 | 44.7 | 0.260 |
| B | 1068 | 29.1 | 42.7 | 43.3 | 0.261 |
| C | 1200 | 33.8 | 44.5 | 42.3 | 0.252 |
| D | 1200 | 33.7 | 45.2 | 43.3 | 0.253 |

Table 2 show s the mechanical properties obtained for specimens corresponding to the Table 1 specimens, after batch annealing, and then followed by coating and temper roll ing at the processing parameters set forth in the Table.

TABLE 2

| | Coiling Temp. (° F.) | Line Speed (ft/min) | Temper Elongation (%) | Yield Strength (ksi) | Tensile Strength (ksi) | Total Elongation (%) | n-value | YPE (%) |
|---|---|---|---|---|---|---|---|---|
| E | 1068 | 150 | 1.0 | 22.7 | 45.1 | 45.5 | 0.228 | 0.06 |
| F | | | 1.5 | 22.3 | 44.9 | 41.6 | 0.228 | 0.12 |
| G | | | 2.0 | 29.4 | 46.9 | 39.8 | 0.198 | 0.07 |
| H | | 350 | 1.0 | 21.7 | 44.0 | 44.8 | 0.234 | 0.08 |
| I | | | 1.5 | 26.0 | 44.5 | 43.2 | 0.213 | 0.22 |
| J | | | 2.0 | 27.7 | 45.2 | 39.4 | 0.187 | 0.26 |
| K | 1200 | 150 | 1.5 | 30.0 | 49.2 | 35.7 | 0.179 | 0.18 |
| L | | | 2.0 | 29.0 | 48.5 | 33.4 | 0.181 | 0.09 |
| M | | 350 | 1.5 | 28.2 | 47.8 | 39.2 | 0.191 | 0.15 |
| N | | | 2.0 | 30.1 | 48.9 | 32.6 | 0.171 | 0.13 |

In order to determine the anti-aging properties of the steels, an accelerated aging testing was carried out by holding the specimens at 212° F. (100° C.) for 60 minutes. It is generally understood that a steel will be considered to be essentially non-aging if there is no significant evidence of YPE (yield point elongation) observed after aging testing, i.e., if the YPE is less than about 0.3% after aging testing under these conditions. The mechanical property data provided in Table 2 includes the aging resistance of the steels in terms of YPE for the noted processing conditions. It can be seen that these steels exhibit excellent resistance to aging, or, stated another way, exhibit non-aging properties.

The temper rolled steel sheet was also subjected to standard bake hardening simulation testing, consisting of applying a 2% tensile prestrain followed by holding 30 minutes at 350° F. (177° C.). The measurements indicating the strain and bake hardening response for the specimens listed in Table 2 are presented in Table 3.

TABLE 3

| | Coiling Temp. (° F.) | Line Speed (ft/min) | Temper Elongation (%) | 2% Strain Hardening after Prestarin (ksi) | Bake Hardening (ksi) | Total Hardening after Testing (ksi) |
|---|---|---|---|---|---|---|
| E | 1068 | 150 | 1 | 6.4 | 8.3 | 14.7 |
| F | | | 1.5 | 5.1 | 7.7 | 12.8 |
| G | | | 2.0 | 6.1 | 6.3 | 12.4 |
| H | | 350 | 1 | 6.0 | 8.2 | 14.2 |
| I | | | 1.5 | 6.1 | 8.0 | 14.1 |
| J | | | 2.0 | 6.1 | 6.3 | 12.4 |
| K | 1200 | 150 | 1.5 | 6.4 | 9.1 | 15.5 |
| L | | | 2.0 | 6.0 | 9.0 | 15.0 |
| M | | 350 | 1.5 | 6.0 | 9.4 | 15.4 |
| N | | | 2.0 | 6.7 | 9.4 | 16.1 |

EXAMPLE 2

Steel melts having the compositions shown in Table 4 below were prepared in a converter and the resulting steels were subjected to hot rolling, pickling, cold rolling, batch annealing, coating and temper rolling.

TABLE 4

| Steel | C | Mn | P | S | Si | Al | $N_2$ | Cu | Ni |
|---|---|---|---|---|---|---|---|---|---|
| P | 0.043 | 0.21 | 0.011 | 0.018 | 0.016 | 0.031 | 0.0040 | 0.021 | 0.009 |
| Q | 0.044 | 0.29 | 0.012 | 0.012 | 0.012 | 0.039 | 0.0030 | 0.027 | 0.010 |
| R | 0.024 | 0.22 | 0.010 | 0.010 | 0.006 | 0.038 | 0.0050 | 0.027 | 0.005 |

The finishing exit temperature and coiling temperature employed in producing hot bands of the above steel compositions are summarized in Table 5.

TABLE 5

| Steel | Finishing Exit Temperature (° F.) | Coiling Temperature (° F.) |
|---|---|---|
| P | 1619 | 1022 |
| Q | 1622 | 1164 |
| R | 1600 | 973 |

Hot bands with final thicknesses of 0.104" were cold-rolled to a 0.029" finish gauge and then transferred to a batch annealing furnace. The staged batch annealing thermal cycle of the present invention was then employed. The hot and cold spot temperatures at the first stage (intercritical stage) of this cycle were 1430 and 1400° F., respectively. Following the first stage, the steels were cooled at a rate of about 20° F./hour until reaching a temperature for performing the second stage (subcritical stage) of the batch anneal. The hot and cold spot temperatures were reduced to 1310 and 1290° F. in the second stage. The annealed coils were subsequently zinc coated on a hot dip galvanizing line with a maximum steel temperature of 1090° F. (588° C.) for steels P and Q, and 1160° F. (627° C.) for steel R. The line speed and temper rolling extension employed during processing were 250 ft/min and 1.0%, respectively.

The mechanical properties, as well as strain and bake hardening properties obtained with the coils produced in accordance with the above are summarized in Tables 6 and 7, respectively.

TABLE 6

| Steel | Test Position | Ys (ksi) | Ts (ksi) | EL (%) | n-value | YPE (%) |
|---|---|---|---|---|---|---|
| P | Head | 29.3 | 48.4 | 35.8 | 0.187 | 0.02 |
| P | Tail | 28.3 | 47.9 | 35.2 | 0.204 | 0.01 |
| Q | Head | 30.4 | 50.1 | 37.2 | 0.196 | 0.000 |
| Q | Tail | 30.0 | 49.9 | 38.0 | 0.205 | 0.010 |
| R | Head | 27.3 | 47.6 | 37.6 | 0.208 | 0.000 |
| R | Tail | 26.3 | 46.2 | 39.8 | 0.198 | 0.006 |

TABLE 7

| Steel | Test Position | 2% Strain Hardening after Prestrain (ksi) | Bake Hardening (ksi) | Total Hardening after Testing (ksi) |
|---|---|---|---|---|
| P | Head | 7.2 | 6.2 | 13.4 |
| P | Tail | 6.3 | 6.3 | 12.6 |
| Q | Head | 6.0 | 6.3 | 12.3 |
| Q | Tail | 7.0 | 7.0 | 14.0 |
| R | Head | 6.8 | 6.8 | 13.6 |
| R | Tail | 6.6 | 6.6 | 13.2 |

It can be seen from the foregoing that a highly advantageous method for producing bake hardenable cold-rolled steel sheet, and an inexpensive steel alloy composition that can be processed to be highly formable as well as bake hardenable, are provided by the present invention. In particular, the use of batch annealing, and more specifically, a two stage batch annealing, yields these desirable steel sheet products.

The foregoing description of the preferred embodiments of the present invention is provided for illustrative purposes only. It is to be understood that various changes and modifications to the invention may be apparent, or will become apparent, to those having ordinary skill in the art, and that those changes or modifications do not depart from the spirit or scope of the present invention. Accordingly, the scope of the present invention is to be determined by reference to the appended claims.

What is claimed is:

1. A process for producing a ferritic cold-rolled steel sheet comprising the steps of:

cold rolling a steel sheet employing a reduction of at least about 50%;

batch annealing the cold-rolled sheet in a two stage process, wherein, in a first annealing stage, the steel sheet is heated to a temperature higher than an $A_1$ temperature of said steel sheet and lower than an $A_3$ temperature of said steel sheet, holding said steel sheet at said temperature for a first time period, cooling said steel sheet to a subcritical temperature lower than said $A_1$ temperature, but higher than about 900° F. (482° C.), at a cooling rate no higher than about 270° F./hour (150° C./hour); and in a second annealing stage, holding said steel sheet at said subcritical temperature for a second time period; and cooling said steel sheet to a temperature lower than about 752° F. (400° C.) at a cooling rate no higher than about 270° F./hour (150° C./hour); and wherein said second time period is greater than about 30 minutes.

2. A process as recited in claim 1, wherein, in said second annealing stage, said steel sheet is held at a subcritical temperature between said $A_1$ temperature and a temperature not less than about 270° F. (150° C.) lower than said $A_1$ temperature.

3. A process as recited in claim 1, wherein said first predetermined time period is greater than about 30 minutes.

4. A process as recited in claim 1 wherein, prior to cold rolling said steel sheet, the process includes the steps of forming a slab of a steel, hot rolling said slab to form a hot band, and coiling said hot band, wherein said coiled hot band comprises said steel sheet which is then cold-rolled and annealed.

5. A process as recited in claim 4, wherein said slab composition comprises iron and the following elements (in weight percent):

| | |
|---|---|
| C | 0.003 – 0.1 |
| Mn | ≤ 1.5 |
| Si | ≤ 1.0 |
| P | ≤ 0.1 |
| S | ≤ 0.03 |
| N | ≤ 0.01 |
| Al | ≤ 0.2, |

and wherein said steel sheet produced has excellent bake hardenability and formability.

6. A process as recited in claim 5, wherein said cast slab consists essentially of (in weight percent):

| | |
|---|---|
| C | 0.003 – 0.1 |
| Mn | ≤ 1.5 |
| Si | ≤ 1.0 |
| P | ≤ 0.1 |
| S | ≤ 0.03 |
| N | ≤ 0.01 |

-continued

| | |
|---|---|
| Al | ≤ 0.2 |

and the balance Fe and unavoidable impurities.

7. A process as recited in claim 6, wherein said coiling of said hot band is started when said hot band is at a temperature less than or equal to about 1450° F. (788° C.).

8. A process as recited in claim 7, wherein said coiling of said hot band is started when said hot band is at a temperature less than or equal to about 1250° F. (677° C.).

9. A process as recited in claim 1 comprising the further step of coating said steel sheet after said batch annealing with a coating selected from the group consisting of zinc and alloyed zinc.

10. A process as recited in claim 1 comprising the further step of press forming said steel sheet into a predetermined shape.

11. A process for producing a ferritic, cold-rolled steel sheet having excellent formability comprising the steps of:

obtaining a slab or sheet of a steel having a composition consisting essentially of (in weight percent):

| | |
|---|---|
| C | 0.003 – 0.1 |
| Mn | ≤ 1.5 |
| Si | ≤ 1.0 |
| P | ≤ 0.1 |
| S | ≤ 0.03 |
| N | ≤ 0.01 |
| Al | ≤ 0.2 |

balance Fe and unavoidable impurities;

hot rolling said steel to a first thickness;

coiling the hot rolled steel when said hot rolled steel is at a temperature not higher than about 1450° F. (788° C.);

after said hot rolled steel has cooled, cold rolling said steel to a thickness less than about 50% of said first thickness;

batch annealing said steel in a two-phase batch anneal, a first annealing phase of which comprises:

heating said cold-rolled steel to a first temperature in a range of greater than about an $A_1$ temperature of the steel and lower than about an $A_3$ temperature of the steel;

holding said steel at said first temperature for at least about 30 minutes; and then cooling said steel at a cooling rate less than or equal to about 270° F./hour (150° C./hour), to a subcritical temperature below said $A_1$ temperature and above 900° F. (482° C.); and wherein a second annealing phase comprises maintaining said steel at said subcritical temperature for at least about 30 minutes, and then cooling said steel at a cooling rate less than or equal to about 270° F./hour (150° C./hour), to a temperature lower than about 752° F. (400° C.).

12. A process as recited in claim 11 wherein said steel has a composition consisting essentially of (in weight percent):

| | |
|---|---|
| C | 0.024–0.044 |
| Mn | 0.21–0.29 |
| Si | 0.006–0.016 |
| P | 0.010–0.012 |
| S | 0.010–0.018 |
| N | 0.0030–0.0050 |
| Al | 0.031–0.039 |

-continued

| | |
|---|---|
| Cu | 0.021–0.027 |
| Ni | 0.005–0.009, |

and wherein said steel has excellent bake hardenability.

* * * * *